US012043802B2

(12) United States Patent
Ding et al.

(10) Patent No.: US 12,043,802 B2
(45) Date of Patent: Jul. 23, 2024

(54) REACTOR OF UOP PROPANE DEHYDROGENATION APPARATUS AND MAINTENANCE METHOD THEREOF

(71) Applicant: CHINA NATIONAL CHEMICAL ENGINEERING THIRD CONSTRUCTION CO., LTD, Anhui (CN)

(72) Inventors: Long Ding, Anhui (CN); Deqing Zhan, Anhui (CN); Bo Ji, Anhui (CN); Xinyu Pan, Anhui (CN); Ming'ao Wu, Anhui (CN); Wenwei Li, Anhui (CN)

(73) Assignee: CHINA NATIONAL CHEMICAL ENGINEERING THIRD CONSTRUCTION CO., LTD, Hefei (CN)

( * ) Notice: Subject to any disclaimer, the term of this patent is extended or adjusted under 35 U.S.C. 154(b) by 0 days.

(21) Appl. No.: 18/235,367

(22) Filed: Aug. 18, 2023

(65) Prior Publication Data

US 2023/0392080 A1 Dec. 7, 2023

Related U.S. Application Data

(63) Continuation of application No. PCT/CN2022/116999, filed on Sep. 5, 2022.

(30) Foreign Application Priority Data

May 13, 2022 (CN) ..... 202210606770.5

(51) Int. Cl.
*C10G 11/00* (2006.01)

(52) U.S. Cl.
CPC ..... *C10G 11/00* (2013.01); *C10G 2300/1081* (2013.01)

(58) Field of Classification Search
CPC ..... C10G 11/00; C10G 2300/1081
See application file for complete search history.

(56) References Cited

U.S. PATENT DOCUMENTS

| | | | |
|---|---|---|---|
| 6,472,577 | B1 | 10/2002 | Zimmermann et al. |
| 2009/0118557 | A1 | 5/2009 | Merrill et al. |
| 2015/0078970 | A1 | 3/2015 | Iddir et al. |

FOREIGN PATENT DOCUMENTS

| | | | |
|---|---|---|---|
| CN | 1333084 | A | 1/2002 |
| CN | 2813088 | Y | 9/2006 |
| CN | 115121185 | A | 9/2022 |

OTHER PUBLICATIONS

International Search Report of PCT Patent Application No. PCT/CN2022/116999 issued on Dec. 19, 2022.

(Continued)

*Primary Examiner* — Brian A McCaig

(57) ABSTRACT

The application belongs to the technical field of reactor of dehydrogenation apparatus, in particular to reactor of UOP propane dehydrogenation apparatus and maintenance method thereof. The reactor includes a reduction cylinder and a catalytic cylinder connected end to end, and a feeding elbow located at a lower end of the catalytic cylinder. Inside the catalytic cylinder there is a conical distributor, an inner net and an outer net located on a same axis and arranged in sequence from inside to outside. Upper ends of the conical distributor, the inner net and the outer net are all connected with an upper cover plate through bolt gaskets. Through the integral design of the inner net, the outer net and the lower cover plate, it is convenient to lift out as a whole, and workers may be prevented from being dispatched to go down into the narrow reactor to dismantle the bolts.

8 Claims, 4 Drawing Sheets

(56) References Cited

OTHER PUBLICATIONS

Written Opinion of the International Searching Authority of PCT Patent Application No. PCT/CN2022/116999 issued on Dec. 19, 2022.

REACTOR OF UOP PROPANE DEHYDROGENATION APPARATUS AND MAINTENANCE METHOD THEREOF

CROSS-REFERENCE TO RELATED APPLICATIONS

This application is a continuation of International Application No. PCT/CN2022/116999, filed on Sep. 5, 2022, which claims priority to Chinese Patent Application No. 202210606770.5, filed on May 13, 2022. All of the aforementioned applications are incorporated herein by reference in their entireties.

TECHNICAL FIELD

The application belongs to the technical field of reactors of dehydrogenation apparatus, in particular to a reactor of UOP propane dehydrogenation apparatus and maintenance method thereof.

BACKGROUND

A reaction in which hydrogen is removed from a dehydrogenated organic compound at a high temperature and in the presence of a catalyst or dehydrogenating agent is a form of oxidation reaction, and a propane dehydrogenation reactor is a type of production equipment used for propane dehydrogenation.

Most of the propane dehydrogenation reactors are large in volume and heavy in mass, including a reduction section, a catalytic section, and a feeding elbow, the catalytic section includes an inner net, an outer net, and a conical distributor, which need to be hoisted in the process of installation and maintenance. Problems of displacements of the inner net and the outer net are extremely prone to occur during the process of hoisting in maintenance, which greatly reduce the safety of hoisting. The inner net and the outer net are dismantled separately when disassembling for maintenance. When dismantling the inner net, it requires to take a manned tray and lower the manned tray to a bottom of the reactor, and to dismantle a bolt connecting inner net and the outer net. When dismantling the outer net, it requires to enter an interlayer between an equipment shell layer and the outer net. However, when there are the inner net and the outer net inside the reactor, space for activity is extremely narrow, which makes it inconvenient for workers to operate. Further, the existence of the inner net and the outer net may cause non circulation of air at the bottom of the reactor. Moreover, there still remain gases that are unfavorable to human body at the bottom of the reactor, so workers entering the reactor are with certain risks. Therefore, the reactor of UOP propane dehydrogenation apparatus and maintenance method thereof are proposed.

SUMMARY

In order to solve the above problems, a primary object of the application is to provide a reactor of UOP propane dehydrogenation apparatus and maintenance method thereof.

The above purpose is achieved by the following preparation process.

A reactor of UOP propane dehydrogenation apparatus, including:

a reduction cylinder and a catalytic cylinder connected through a sealing flange, and a feeding elbow located at a lower end of the catalytic cylinder, inside the catalytic cylinder there are a conical distributor, an inner net and an outer net located on a same axis and arranged in sequence from inside to outside, upper ends of the conical distributor, the inner net and the outer net are all connected with an upper cover plate through bolt gaskets.

Lower ends of the inner net and the outer net are connected with a lower cover plate through connecting bolts, an expansion joint structure is movably installed between a lower end of the lower cover plate and an inner wall of a bottom end of the catalytic cylinder, and a conical transition section is arranged between the inner net and a feeding inlet of the feeding elbow.

As a further improvement of the above technical solution, an upper catalyst conveying pipe is arranged through both ends of the upper cover plate located between the inner net and the outer net, and a lower catalyst conveying pipe is arranged on both sides of the lower ends of the lower cover plate located between the inner net and the outer net.

As a further improvement of the above technical solution, a limiting casing pipe cased with the lower catalyst conveying pipe is arranged at the lower end of the catalytic cylinder.

As a further improvement of the above technical solution, a central purging pipe extending to an inner bottom of the conical distributor is arranged at the axis of the upper cover plate located at the upper end of the conical distributor, and the central purging pipe located above the upper cover plate extends to the outside of the reduction cylinder through a right-angle pipe.

As a further improvement of the above technical solution, the lower cover plate is annular, and a bottom end is flush with bottom ends of the inner net and the outer net, and the connecting bolts between the inner net, the outer net and the lower cover plate are located on one side of the inner net and the outer net respectively.

As a further improvement of the above technical solution, the expansion joint structure includes an outer ring plate and an inner ring plate whose lower ends are integrally connected and have a height difference, an outer expansion portion is arranged in the vertical direction of the outer ring plate, an inner expansion portion is arranged in the vertical direction of the inner ring plate, a connecting ring is arranged between a flush position of an upper end of the inner ring plate and the outer ring plate, the inner side of a top end of the inner ring plate is provided with an inclined surface matched with the conical transition section, and a chute using for sliding of the connecting ring is arranged on the outer wall of the outer ring plate, a screw extending above the connecting ring is arranged at an upper end of the position where bottom ends of the outer ring plate and the inner ring plate are connected integrally, a bolt is arranged on the head of the screw.

As a further improvement of the above technical solution, a slot is arranged on an upper end of the outer ring plate, and the bottom end of the lower cover plate is connected with the slot through a sealing snap ring, the sealing snap ring is made of a thermal expansion and cold contraction material.

As a further improvement of the above technical solution, an evenly distributed anti-deformation rod is arranged between the inner net and the outer net in the vertical direction, one end of the anti-deformation rod is fixed on the outer net, and another end is connected with a wedge being arranged with an inclined surface at an upper end through an elastic telescopic rod and a connecting rod, the outer wall of the inner net is arranged with a wedge groove matched with the wedge.

A maintenance method for the above reactor of UOP propane dehydrogenation apparatus is provided, including the following steps.

(1) A neutralization liquid is injected into the reactor and then the neutralization liquid is discharged for cooling; a structure, a pipeline, an electric heater and instrument parts, in the upper part of the reactor that hinder the hoisting of internal parts, are dismantled.

(2) A reduction cylinder is hoisted and removed, an upper cover plate connected with a conical distributor, an inner net and an outer net is dismantled, colored strip cloth is laid on the steel grille of the conical distributor to prevent dismantling tools and screws from falling into the distributor, and then the conical distributor is lifted and removed.

(3) The connection between a feeding elbow and the catalytic cylinder is removed, after protecting connecting flanges with a black rubber, three chain blocks are used to work simultaneously, and an elbow is slowly laid down vertically to an appropriate position.

(4) Marks are made on lifting lugs and cylinders of the inner net and the outer net, and then the inner net, the outer net and the lower cover plate are lifted out as a whole, after lifting out, on the one hand, the inner net, the outer net and the lower cover plate are dismantled, on the other hand, workers are dispatched to go down to the bottom of the cylinders to overhaul an expansion joint structure.

(5) After cleaning and overhauling components of the reactor, the components are reinstalled in turn according to the dismantling sequence.

The application has the following beneficial effects.

(1) Through the integral design of the inner net, the outer net and the lower cover plate, it is convenient to lift out as a whole, and workers may be prevented from being dispatched to go down into the narrow reactor to dismantle the bolts, avoiding personnel injury.

(2) Through the design of inner net, outer net, anti-deformation rod and other structures, the inner net and the outer net may be prevented from twisting and deforming. Moreover, after the lifting out process, and after removing the connecting bolt of the inner net, it may make the inner net slowly separate from the outer net due to its own weight.

(3) Through the arranged expansion joint structure, when in use, it on the one hand compensates the transverse and axial displacement of the inner net and the outer net, on the other hand, it prevents deformation or damage caused by thermal elongation or temperature stress when the conical transition section heats up and increases stability. Moreover, after the inner net, the outer net and the lower cover plate are dismantled as a whole, due to the design of the screw, the outer ring plate and the inner ring plate, the bouncing up of the expansion joint structure may be prevented, thus avoiding the problem of causing the outer net not to be able to be reinstalled.

Reference signs: 1. Catalytic cylinder; 2. Reduction cylinder; 3. Conical distributor; 4. inner net; 5. outer net; 61. Upper catalyst conveying pipe; 62. Lower catalyst conveying pipe; 7. Feeding elbow; 8. Expansion joint structure; 81. Outer ring plate; 82. Inner ring plate; 83. Outer expansion portion; 84. Inner expansion portion; 85. Screw; 86. Chute; 9. Central purging pipe; Lower cover plate; 11. Sealing snap ring; 12. Connecting bolt; 13. Anti-deformation rod; 14. Wedge; 15. Wedge groove; 16. Connecting rod; 17. Elastic telescopic rod; 18. Conical transition section.

DETAILED DESCRIPTION OF THE EMBODIMENTS

The application is described in further detail below in conjunction with the accompanying drawings. It is necessary to point out here that the following specific embodiments are only for further explanation of this application, and cannot be understood as a limitation on the scope of protection of the application. Those skilled in the art may make some non-essential improvements and adjustments to the application in accordance with the content of the application as described above.

Figure 1:
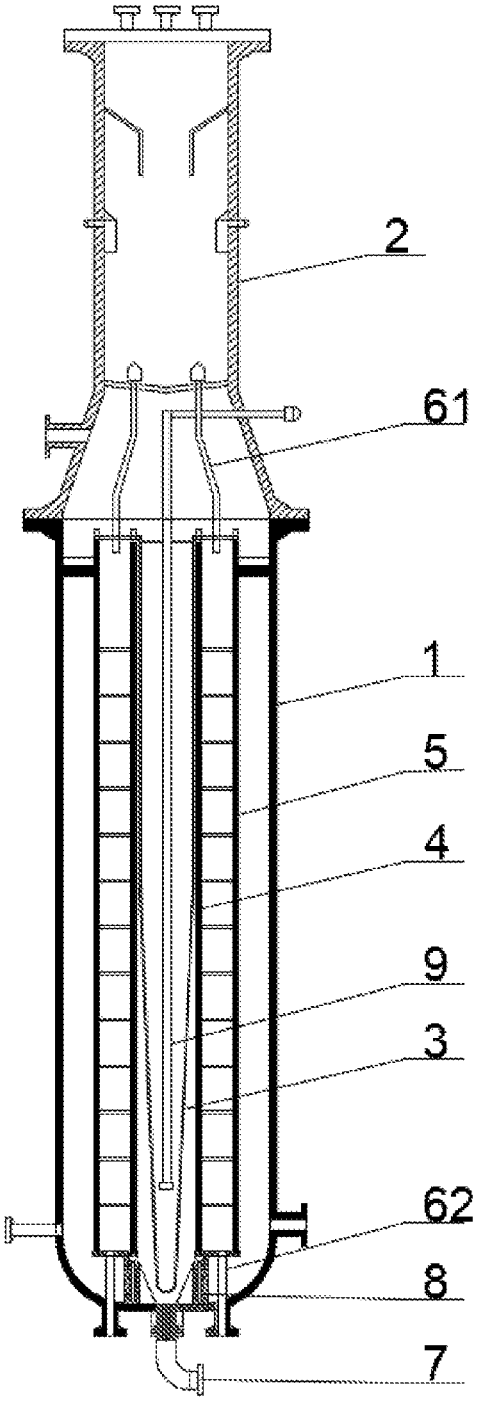
FIG. 1 is a schematic diagram of an internal structure of a reactor of UOP propane dehydrogenation apparatus according to the application.
Figure 2:
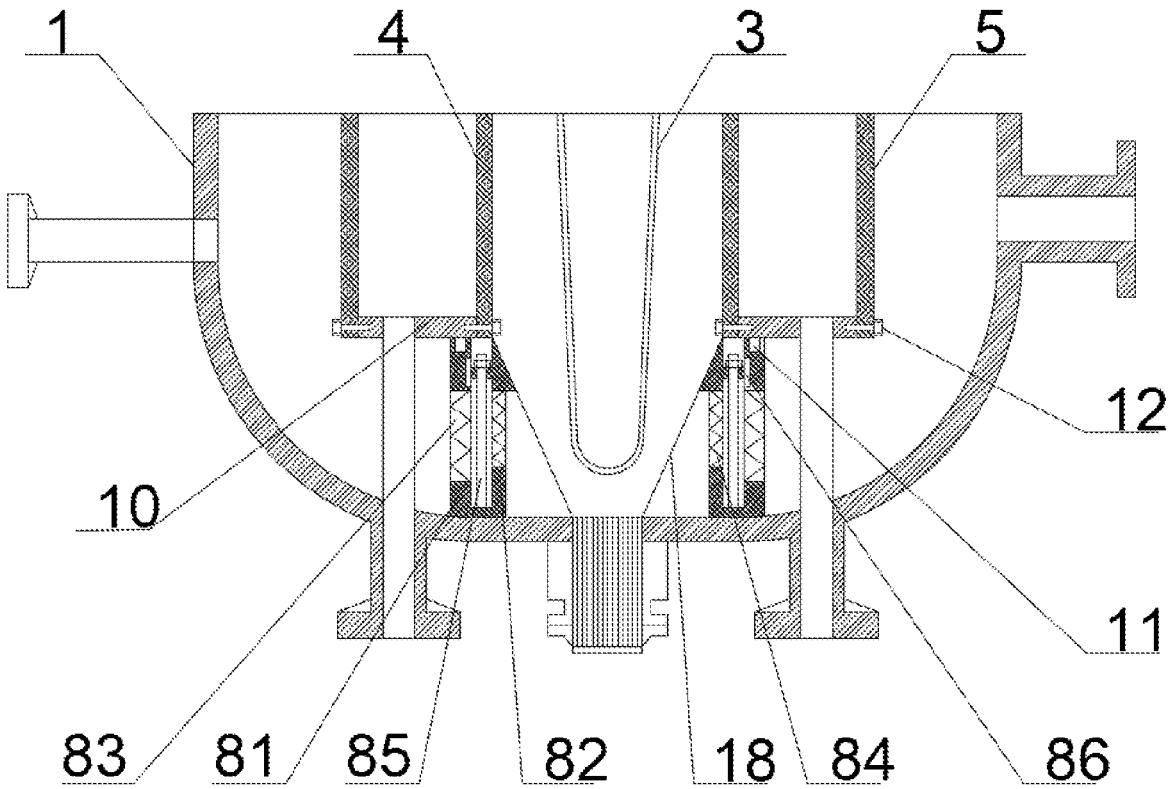
FIG. 2 is a schematic diagram of a bottom structure of a reactor of UOP propane dehydrogenation apparatus according to the application.
Figure 3:
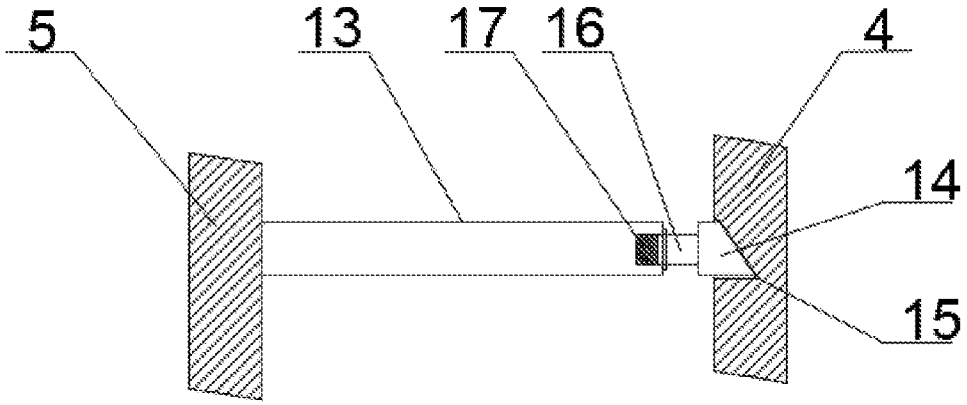
FIG. 3 is a schematic diagram of connection of an inner net and an outer net of a reactor of UOP propane dehydrogenation apparatus according to the application.

As shown in FIGS. 1 to 3, a reactor of UOP propane dehydrogenation apparatus of the present embodiment includes:

a reduction cylinder 2 and a catalytic cylinder 1 connected end to end through a sealing flange, and a feeding elbow 7 located at a lower end of the catalytic cylinder 1, there are small expansion joints arranged around the feeding elbow 7. Inside the catalytic cylinder 1 there are a conical distributor 3, an inner net 4 and an outer net 5 located on a same axis and arranged in sequence from inside to outside. Upper ends of the conical distributor 3, the inner net 4 and the outer net 5 are all connected with an upper cover plate through bolt gaskets. Lower ends of the inner net 4 and the outer net 5 are both connected with lower cover plates 10 through connecting bolts 12. The lower cover plate 10 is annular, and a bottom end of the lower cover plate 10 is flush with a bottom end of the inner net 4 and a bottom end of the outer net 5. The connecting bolts 12 between the inner net 4, the outer net 5 and the lower cover plates 10 are located on one side of the inner net 4 and the outer net 5 respectively, which makes it convenient for workers to dismantle the connecting bolts 12 after the inner net 4, the outer net 5 and the lower cover plates are lifted out as a whole. An expansion joint structure 8 is movably installed between a lower end of the lower cover plate 10 and the inner wall of a bottom end of the catalytic cylinder 1, and a conical transition section 18 is arranged between the inner net 4 and the feeding inlet of the feeding elbow 7.

An upper catalyst conveying pipe 61 is arranged through both ends of the upper cover plate located between the inner net 4 and the outer net 5. A lower catalyst conveying pipe 62 is arranged on both sides of the lower ends of the lower cover plates 10 located between the inner net 4 and the outer net 5, herein, the lower catalyst conveying pipe 62 may also be fixedly connected with the bottom end of the outer net 5 through the lower cover plates 10. A limiting casing pipe cased with the lower catalyst conveying pipe 62 is arranged around the feeding elbow 7 at the lower end of the catalytic cylinder 1, and a small expansion joint is arranged at the outer connection of the lower catalyst conveying pipe 62 and the limiting casing pipe. After the inner net, the outer net and the lower cover plates are lifted out as a whole, the lower catalyst conveying pipe 62 is lifted out at the same time.

A central purging pipe 9 extending to the inner bottom of the conical distributor 3 is arranged at the axis of the upper cover plate located at the upper end of the conical distributor 3. The central purging pipe 9 located above the upper cover plate extends to the outside of the reduction cylinder 2 through a right-angle pipe, and the central purging pipe 9 and the right-angle pipe are connected through flanges.

The expansion joint structure 8 includes an outer ring plate 81 and an inner ring plate 82 whose lower ends are integrally connected and have a height difference. An outer expansion portion 83 is arranged in the vertical direction of the outer ring plate 81. The inner side of a top end of the inner ring plate 82 is provided with an inclined surface matched with the conical transition section 18. The outer ring plate 81 and the outer expansion portion 83 compensate the transverse and axial displacement of the inner net and the outer net. An inner expansion portion 84 is arranged in the vertical direction of the inner ring plate 82. The inclined surface of the top end of the inner ring plate 82 and the inner expansion portion 84 cooperate to prevent deformation or damage caused by thermal elongation or temperature stress when the conical transition section 18 heats up and increase stability. A connecting ring is arranged between the flush position of an upper end of the inner ring plate 82 and the outer ring plate 81, and a chute 86 using for sliding of the connecting ring is arranged on the outer wall of the outer ring plate 81. A screw 85 extending above the connecting ring is arranged at an upper end of the position where bottom ends of the outer ring plate 81 and the inner ring plate 82 are connected integrally. A bolt is arranged on the head of the screw 85, which facilitates the adaptability between the conical transition section 18 of different specifications and the inner ring plate 82 during installation, and the fixed connection between the screw 85 and the connecting ring prevents the expansion joint from losing gravity and bouncing up after dismantling the inner and outer nets; instead, the expansion joint may be under its own pulling force.

A slot is arranged on an upper end of the outer ring plate 81, and the bottom end of the lower cover plate 10 is connected with the slot through a sealing snap ring 11. Such connection is simple and easy to be dismantled. The sealing snap ring 11 is made of a thermal expansion and cold contraction material, which increases the sealing performance in the reaction process.

An evenly distributed anti-deformation rod 13 is arranged between the inner net 4 and the outer net 5 in the vertical direction. One end of the anti-deformation rod 13 is fixed on the outer net 5, and another end is connected with a wedge 14 being arranged with an inclined surface at an upper end through an elastic telescopic rod 17 and a connecting rod 16. The outer wall of the inner net 4 is arranged with a wedge groove 15 matched with the wedge 14, which may prevent the inner net 4 and the outer net 5 from twisting and deforming. Moreover, after the lifting out process, and after removing the connecting bolt 12 of the inner net 4, it may make the inner net 4 slowly separate from the outer net 5 due to its own weight. Specifically, when the connecting bolt 12 of the inner net 4 is released, the inner net 4 falls due to its own weight, but it will be blocked by the wedge 14 at the same time. Also, since the wedge 14 has the inclined surface, although it may be blocked as it falls, such falling is not hindered. The inner net 4 is hoisted from the top into the outer net 5 first when reinstalling, and after matching the groove, the inner net 4 directly corresponds to the outer net 5 due to its own weight.

Figure 4:
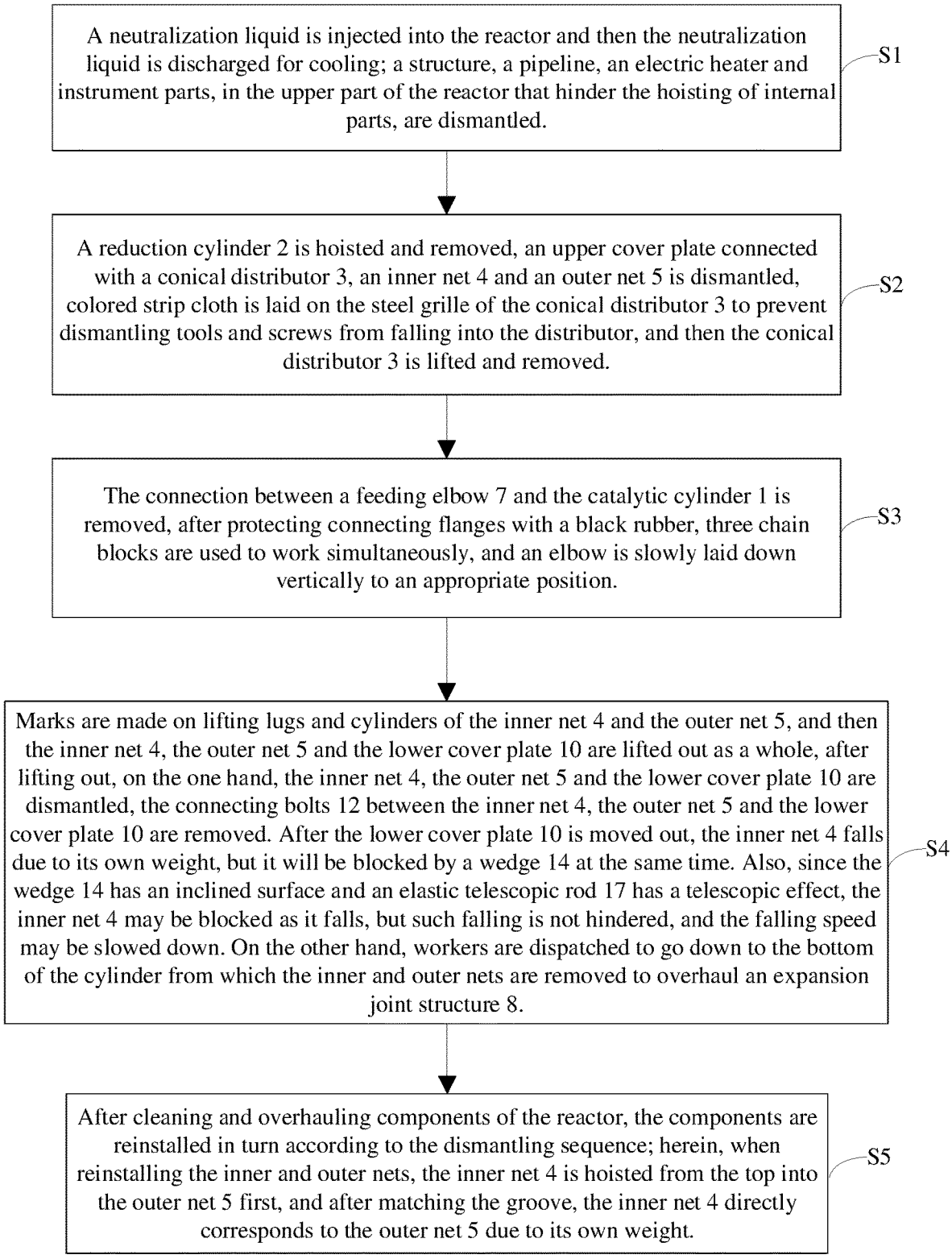
FIG. 4 is a maintenance method of the reactor of UOP propane dehydrogenation apparatus of the embodiment according to the application.

As shown in FIG. 4, a maintenance method of the reactor of UOP propane dehydrogenation apparatus of the embodiment is provided, including the following steps.

S1, a neutralization liquid is injected into the reactor and then the neutralization liquid is discharged for cooling; a structure, a pipeline, an electric heater and instrument parts, in the upper part of the reactor that hinder the hoisting of internal parts, are dismantled.

S2, a reduction cylinder 2 is hoisted and removed, an upper cover plate connected with a conical distributor 3, an inner net 4 and an outer net 5 is dismantled, colored strip cloth is laid on the steel grille of the conical distributor 3 to prevent dismantling tools and screws from falling into the distributor, and then the conical distributor 3 is lifted and removed.

S3, the connection between a feeding elbow 7 and the catalytic cylinder 1 is removed, after protecting connecting flanges with a black rubber, three chain blocks are used to work simultaneously, and an elbow is slowly laid down vertically to an appropriate position.

S4, marks are made on lifting lugs and cylinders of the inner net 4 and the outer net 5, and then the inner net 4, the outer net 5 and the lower cover plate 10 are lifted out as a whole, after lifting out, on the one hand, the inner net 4, the outer net 5 and the lower cover plate 10 are dismantled, the connecting bolts 12 between the inner net 4, the outer net 5 and the lower cover plate 10 are removed. After the lower cover plate 10 is moved out, the inner net 4 falls due to its own weight, but it will be blocked by a wedge 14 at the same time. Also, since the wedge 14 has an inclined surface and an elastic telescopic rod 17 has a telescopic effect, the inner net 4 may be blocked as it falls, but such falling is not hindered, and the falling speed may be slowed down. On the other hand, workers are dispatched to go down to the bottom of the cylinder from which the inner and outer nets are removed to overhaul an expansion joint structure 8.

S5, after cleaning and overhauling components of the reactor, the components are reinstalled in turn according to the dismantling sequence; herein, when reinstalling the inner and outer nets, the inner net 4 is hoisted from the top into the outer net 5 first, and after matching the groove, the inner net 4 directly corresponds to the outer net 5 due to its own weight.

The above-described embodiments express only several embodiments of the application, the description thereof is more specific and detailed, but are not to be construed as a limitation of the scope of the application. It should be noted that, for those of ordinary skill in the art, a number of modifications may be made without departing from the conception of the application, all of which fall within the scope of protection of the application.

What is claimed is:

1. A reactor of an UOP propane dehydrogenation apparatus, comprising:

a reduction cylinder; and a catalytic cylinder located below the reduction cylinder, along a vertical direction of the reactor of UOP propane dehydrogenation apparatus; wherein the reduction cylinder and the catalytic cylinder are connected through a sealing flange, and a feeding elbow is located at the bottom of the catalytic cylinder, inside the catalytic cylinder there is a conical distributor, an inner net and an outer net located on a same axis and arranged in sequence from inside to outside, the top of the conical distributor, the inner net and the outer net are all connected with an upper cover plate through bolt gaskets;

the bottom of the inner net and the outer net are connected with a lower cover plate through connecting bolts, an expansion joint structure is movably installed between the bottom of the lower cover plate and an inner wall of a bottom end of the catalytic cylinder, and a conical transition section is arranged between the inner net and a feeding inlet of the feeding elbow;

an evenly distributed anti-deformation rod is arranged between the inner net and the outer net in a vertical direction, one end of the anti-deformation rod is fixed on the outer net, and another end is connected with a wedge being arrange with an inclined surface at the top through an elastic telescopic rod and a connecting rod, an outer wall of the inner net is arranged with a wedge groove matched with the wedge.

2. The reactor of UOP propane dehydrogenation apparatus according to claim 1, wherein, an upper catalyst conveying pipe is arranged through both ends of an upper cover plate located between the inner net and the outer net, a lower catalyst conveying pipe is arranged on both sides of the bottom of the lower cover plate located between the inner net and the outer net.

3. The reactor of UOP propane dehydrogenation apparatus according to claim 2, wherein, a limiting casing pipe cased with the lower catalyst conveying pipe is arranged at the bottom of the catalytic cylinder.

4. The reactor of UOP propane dehydrogenation apparatus according to claim 1, wherein, a central purging pipe extending to an inner bottom of the conical distributor is arranged at an axis of the upper cover plate located at the top of the conical distributor, the central purging pipe 9 located above the upper cover plate extends to the outside of the reduction cylinder through a right-angle pipe.

5. The reactor of UOP propane dehydrogenation apparatus according to claim 1, wherein, the lower cover plate is annular, and a bottom end is flush with bottom ends of the inner net and the outer net, and connecting bolts between the inner net, the outer net and the lower cover plate are located on one side of the inner net and the outer net respectively.

6. The reactor of UOP propane dehydrogenation apparatus according to claim 1, wherein, the expansion joint structure comprises an outer ring plate and an inner ring plate whose bottom ends are integrally connected and have a height difference, an outer expansion portion is arranged in a vertical direction of the outer ring plate, an inner expansion portion is arranged in a vertical direction of the inner ring plate, and an inner side of a top end of the inner ring plate is provided with an inclined surface matched with the conical transition section, a connecting ring is arranged between the flush position of a top end of the inner ring plate and the outer ring plate, and a chute using for sliding of the connecting ring is arranged on an outer wall of the outer ring plate;

a screw extending above the connecting ring is arranged at the top where bottom ends of the outer ring plate and the inner ring plate are connected integrally, a bolt is arranged on a head of the screw.

7. The reactor of UOP propane dehydrogenation apparatus according to claim 1, wherein, a slot is arranged on the top of the outer ring plate, and the bottom end of the lower cover plate is connected with the slot through a sealing snap ring, the sealing snap ring is made of a thermal expansion and cold contraction material.

8. A maintenance method for the reactor of UOP propane dehydrogenation apparatus according to claim 1, comprising:

S1, injecting a neutralization liquid into the reactor and then discharging the neutralization liquid for cooling, dismantling a structure, a pipeline, an electric heater and instrument parts in an upper part of the reactor that hinder the hoisting of internal parts;

S2, removing a connection between the reduction cylinder and the catalytic cylinder, hoisting and removing the reduction cylinder, dismantling the upper cover plate connected with the conical distributor, the inner net and the outer net, laying colored strip cloth on a steel grille of the conical distributor to prevent dismantling tools and screws from falling into the distributor, and then lifting and removing the conical distributor;

S3, removing a connection between the feeding elbow and the catalytic cylinder, after protecting connecting flanges with a black rubber, using three chain blocks to work simultaneously, slowly laying down the feeding elbow vertically to an appropriate position;

S4, making marks on lifting lugs and cylinders of the inner net and the outer net, and then lifting out the inner net, the outer net and the lower cover plate as a whole, after lifting out, on the one hand, dismantling the inner net, the outer net and the lower cover plate, on the other hand, dispatching workers to go down to a bottom of the cylinders to overhaul the expansion joint structure;

S5, after cleaning and overhauling components of the reactor, reinstalling the components in turn according to a dismantling sequence.

* * * * *